US005114836A

United States Patent [19]

Sato et al.

[11] Patent Number: 5,114,836

[45] Date of Patent: May 19, 1992

[54] METHOD OF DEVELOPMENT COMPRISING INTERMITTENTLY SPRAYING A PHOTOGRAPHIC MATERIAL

[75] Inventors: Kiyoshi Sato; Masaaki Taguchi; Yasunori Wada; Mikio Kawasaki; Shinichi Ohtani, all of Hachioji; Masatosi Iwada, Akishima; Noboru Hatakeyama, Sagamihara, all of Japan

[73] Assignee: Konica Corporation, Tokyo, Japan

[21] Appl. No.: 554,528

[22] Filed: Jul. 19, 1990

Related U.S. Application Data

[63] Continuation-in-part of Ser. No. 473,812, Feb. 2, 1990.

[30] Foreign Application Priority Data

| | | | |
|---|---|---|---|
| Feb. 7, 1989 | [JP] | Japan | 1-27820 |
| Apr. 11, 1989 | [JP] | Japan | 1-92656 |
| Jul. 28, 1989 | [JP] | Japan | 1-195644 |
| Mar. 1, 1990 | [JP] | Japan | 2-49828 |
| Apr. 18, 1990 | [JP] | Japan | 2-102737 |

[51] Int. Cl.[5] ..... G03C 5/24

[52] U.S. Cl. ..... 430/434; 430/438; 430/466; 430/499; 430/963

[58] Field of Search ..... 430/434, 438, 466, 499, 430/963

[56] References Cited

U.S. PATENT DOCUMENTS

| | | | |
|---|---|---|---|
| 3,334,566 | 8/1967 | Friedel | 95/89 |
| 3,826,228 | 7/1974 | Glover | 118/255 |
| 3,960,567 | 6/1976 | Hayashi | 96/66.5 |
| 4,562,140 | 12/1985 | Kohmura et al. | 430/523 |
| 4,868,098 | 9/1989 | Steiger et al. | 430/963 |
| 4,954,425 | 9/1990 | Iwano | 430/434 |

FOREIGN PATENT DOCUMENTS

| | | | |
|---|---|---|---|
| 1447043 | 11/1968 | Fed. Rep. of Germany | 430/434 |
| 235940 | 9/1988 | Japan | 430/434 |

OTHER PUBLICATIONS

Burkin, A. R., "Ultra-Rapid Processing of Photographic Materials," Photographic Journal, vol. 87B, 1947, pp. 108-111.

Crabtree, J. I., "Rapid Processing of Forms and Papers," PSA Journal, vol. 15, Feb. 1949, pp. 130-136.

"Accelerated Processing," Photo Methods Industry, Feb. 1959, pp. 32-73.

Houston Fearless Corp., "Rapid Spray Film Processor," Journal of the SMPTE, Jun. 1959, p. 444.

A. Lovichi, "New Method of Development by Jet Without Immersion of the Film," Sci. Ind. Phot. 16, 129-137 (1945), Chemical Abstracts & Indexes, vol. 40, No. 3689 (Jul. 10, 1946).

European Search Report.

A New Development Method Using a Jet that does not Require Immersion of the Film by A. Lovichi, Photographic Science and Industries, 2nd Series, vol. XVI, May-Jun. 1945 (French to English translation).

*Primary Examiner*—Hoa Van Le

*Attorney, Agent, or Firm*—Finnegan, Henderson, Farabow, Garrett, and Dunner

[57] ABSTRACT

A method of developing a silver halide photographic material is disclosed. The method comprises a step of supplying a developer to a surface of an exposed silver halide photographic material, which is transferred by at least one pair of rollers, intermittently at least twice wherein an interval time of each supplying is not more than 10 seconds and the amount of developer retained in the light-sensitive material ranges from 50 to 250 ml/m$^2$. The method provides a compact developing system, which is free from uneven development with good graininess of the image.

8 Claims, 2 Drawing Sheets

METHOD OF DEVELOPMENT COMPRISING INTERMITTENTLY SPRAYING A PHOTOGRAPHIC MATERIAL

This is a continuation-in-parts application of Ser. No. 473,812 filed Feb. 2, 1990.

FIELD OF INDUSTRIAL APPLICATION

The present invention relates to a method of developing an exposed silver halide photographic light-sensitive material, more specifically to a method of developing a silver halide photographic light-sensitive material which is free of uneven development and which ensures constant obtainment of excellent development processability and stable graininess.

BACKGROUND OF THE INVENTION

Traditionally, a silver halide photographic light-sensitive material has usually been processed using an automatic processing machine. For example, an image is obtained by subjecting a light-sensitive material to imagewise exposure, then transferring it to a developing tank by means of a roller transfer mechanism, and immersing it in the developer being stored in the developing tank for a given period.

Problems posed by such a method of development include exhaustive deterioration of active ingredients of the developer being stored in the developing tank during the running treatment process, and inactivation of the developing agent due to time-related oxidation. As for oxidation, it can be prevented to some extent by reducing the area of the opening of the developing tank, but deterioration during storage is inevitable as long as the solution is used repeatedly.

There have been many proposals regarding a method of preventing these developer deteriorations. For example, Japanese Patent Publication Open to Public Inspection Nos. 144502/1975, 62004/1979, 115039/1980 and 12645/1981 describe methods of recovering exhaustive deterioration of the developer by continuously or intermittently supplying a developer replenisher according to the amount of processing.

However, these methods all have a shortcoming of in constant finish performance because the developer composition for a development which follows the first development changes from that for the first development, strictly speaking, which means that photographic processing characteristics vary among the developing processes.

SUMMARY OF THE INVENTION

It is an object of the present invention to provide a method of developing a silver halide photographic light-sensitive material based on the developer coating system, which is free of uneven development and which offers good graininess for the images obtained.

It is another object of the present invention to provide a method of developing a silver halide photographic light-sensitive material based on the developer coating system, which offers constantly high sensitivity and high density.

A method of the present invention comprises supplying a developer to the surface of the exposed silver halide photographic light-sensitive material.

The developer is supplied preferably at least twice to the surface of the exposed photographic material, and the developer is supplied not more than 10 seconds after the previous supplying. The silver halide photographic light-sensitive material is developed preferably at a developer retentivity of 50 to 250 ml/m$^2$ substantially without immersing the silver halide photographic light-sensitive material in the developer.

The specific procedure of the present developing method without immersing the exposed light-sensitive material is described below.

In the developing method of the present invention, a silver halide photographic light-sensitive material having on both sides of its support a hydrophilic colloidal layer is developed by supplying a developer containing a hydroquinone to the surface of the exposed silver halide photographic material without immersing the silver halide photographic light-sensitive material in the developer.

This silver halide photographic light-sensitive material is a high-sensitivity film such as an X ray film, wherein at least one hydrophilic colloidal layer is formed on both sides of its support, which is formed with a transparent material.

It is preferable that the developer be supplied to both sides of the silver halide photographic light-sensitive material by transferring the silver halide photographic light-sensitive material. The direction of this transfer may be transversal or longitudinal, with preference given to the latter since it permits apparatus installation area reduction.

Also, supply of a developer to the silver halide photographic light-sensitive material means to supply the silver halide photographic light-sensitive material without immersing it in the developer being stored. This mode of supply makes it possible to supply the developer in a given amount required for development, which contributes to prevention of time-related exhaustion of the developer and developer saving.

The developer is supplied to the exposed silver halide photographic light-sensitive material by, for example, coating methods include roller transfer, dip coating and curtain coating. When the viscosity of the developer is low, the developer may be supplied by spraying.

Examples of the hydroquinone used in the developer of the present invention include hydroquinone, chlorohydroquinone and methylhydroquinone, with preference given to hydroquinone. The amount is normally 1 to 20 g per liter developer, preferably 5 to 15 g.

The developer of the present invention may be formulated with a 3-pyrazolidone-based developing agent such as a dialdehyde hardener, an antifogging agent selected from the group comprising indazole, benzimidazole, benzotriazole and mercaptothiazole antifogging agents, a chelating agent, a buffer, an alkali, a dissolution aid, a pH regulator, a development accelerator, a surfactant, etc. according to needs.

Since the fresh developer is always supplied processing can be carried out free of developer exhaustion due to processing and oxidative exhaustion due to contact with air.

In the present invention, a transfer roller is equipped at the developer supply portion. It transfers the silver halide photographic light-sensitive material and supplies the developer to the photographic material by rotation thereof. The transfer roller is preferably kept warm. It may be heated by a heating means such as a heater housed therein, or by forming the transfer roller itself with a ceramic or other material and applying it electricity to generate heat. In addition, in keeping the transfer roller warm, temperature may be controlled according to ambient temperature, developer temperature and other aspects.

Figure 1:
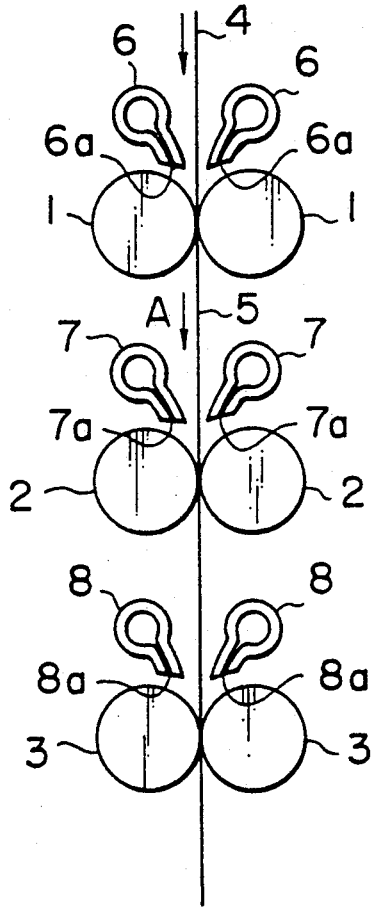
FIG. 1 is a schematic of the light-sensitive material processing apparatus of the present invention.

In these figures, symbols 1 through 3 each represent a transfer roller; 4 represents a silver halide photographic light-sensitive material; 5 represents a transfer pathway, 6 through 8 each represent a supply nozzle; 9 represents a roller portion; 11 and 15 each represent an electric heating wire.

DETAILED DESCRIPTION OF THE INVENTION

The figures illustrate the developing apparatus used in Examples of the present invention.

In this developing apparatus, transfer rollers 1, 2 and 3, each forming a pair, are arranged vertically in three stages. Silver halide photographic light-sensitive material 4 is transferred in the direction of arrow A on the transfer pathway 5 formed with transfer rollers 1, 2 and 3, followed by development.

The upper, middle and lower stages are configured equally. The transfer rollers 1, 2 and 3, each forming a pair, are respectively equipped with supply nozzles 6, 7 and 8, each forming a pair, whose supply tips 6*a* through 8*a* are arranged so that they face the contact faces of the transfer rollers 1, 2 and 3 and opposite to the roller faces.

Silver halide photographic light-sensitive material 4 is transferred in the direction of arrow A by driving motion of the transfer rollers 1, 2 and 3. While the silver halide photographic light-sensitive material 4 is being transferred, the developer is supplied via the supply tips 6*a*, 7*a* and 8*a* of the supply nozzles 6, 7 and 8. This developer runs in the direction of the contact faces of the transfer rollers 1, 2 and 3, each forming a pair, and coated on both sides of the silver halide photographic light-sensitive material 4.

From each of the supply nozzles 6, 7 and 8, a fresh developer is supplied to the silver halide photographic light-sensitive material 4, which then falls from the transfer roller 1 in the upper stage, then falls from the transfer roller 2 in the middle stage, and then falls from the transfer roller 3 in the lower stage and disposed, i.e., the developer is not recycled.

Note that a tray may be arranged under the transfer rollers 1 through 3 to allow the developer to fall therein and the tray may be connected with a piping to circulate the developer in the tray to the supply nozzles by pumping. In this case, the developer can be recycled since developer exhaustion due to processing does not occur and time-related developer exhaustion due to carbon dioxide absorption is suppressed.

Figure 2:
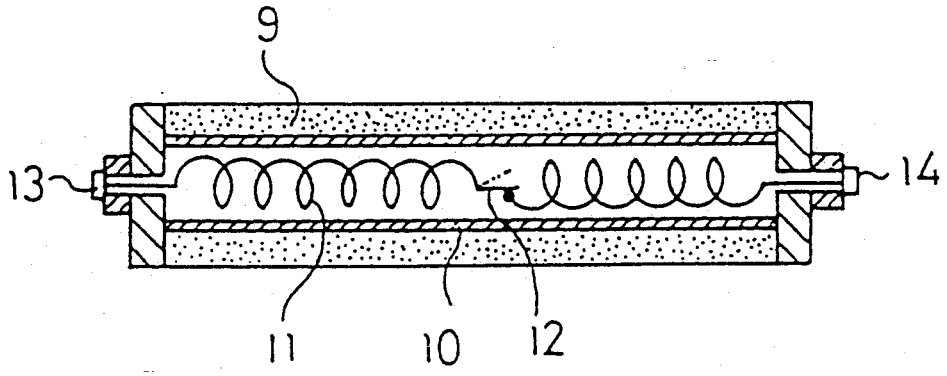
FIG. 2 is a sectional view of a transfer roller.

As illustrated in FIG. 2, the transfer rollers 1, 2 and 3 each have an electric heating wire 11 as housed in the shaft portion 10 of roller portion 9. This electric heating wire 11 is equipped with a thermostat 12, which is adjusted so that the electric heating wire 11 is cut automatically when a specified temperature is reached so as to keep the electric heating wire 11 at a constant temperature. Electrodes 13 and 14 of electric heating wire 11 are projected from the shaft portion. When connecting a lead wire to these electrodes 13 and 14 and supplying electricity, the electric heating wire 11 generates heat to keep the roller portion 9 at a specified temperature. The roller portion 9 is formed with synthetic resin, synthetic rubber, etc., and it is preferable that the warming temperature of this roller portion 9 be the same as the processing temperature for the developer.

Figure 3:
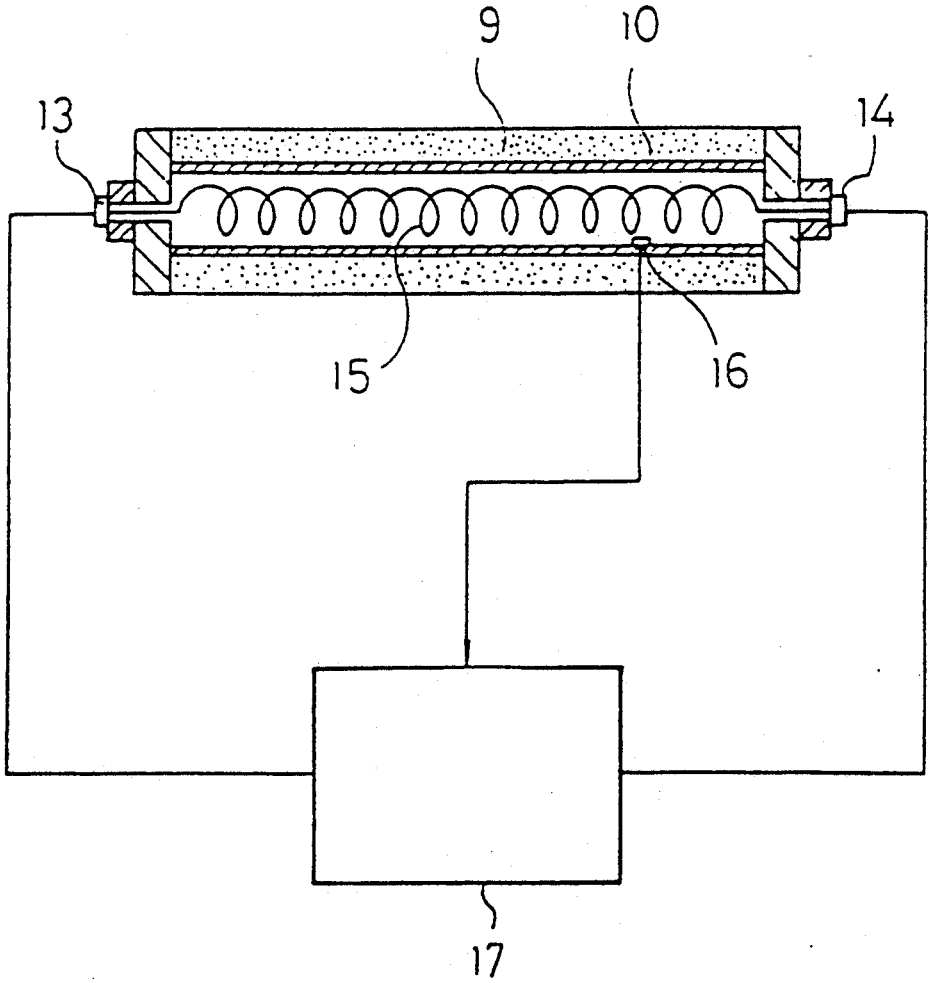
FIG. 3 is a sectional view of a transfer roller in another mode of embodiment.

FIG. 3 shows another mode of embodiment of the present invention. Inside the shaft portion 10 of these transfer rollers 1, 2 and 3 are housed an electric heating wire 15 and a temperature sensor 16. The signal from the temperature sensor 16 is taken out, and power supply to the electric heating wire 15 is switched on and off by means of controller 17 on the basis of this temperature information sent by temperature sensor 17, whereby temperature control is obtained.

Also, in the above-mentioned two modes of embodiment, electric heating wires 11 and 15 are housed in the shaft portion 10 of the roller portion 9, but the electric heating wires may be replaced by rod or platy heaters, etc.

Furthermore, the transfer rollers 1, 2 and 3 are not limited to those equipped with a means of heating such as an electric heating wire or a heater. The roller itself may be warmed at a specified temperature by forming the roller portion itself of the transfer rollers 1, 2 and 3 with a ceramic, etc. and applying electricity to this ceramics.

The present invention is hereinafter described in more detail.

In the present invention, the amount of developer retained in the light-sensitive material depends on the types and amounts of the thickeners added to the developer and the binder in the light-sensitive material.

In the present invention, the amount of developer retained means the amount of adhering developer obtained when the developer is drawn up over a period of 30 seconds after the light-sensitive material, prepared at a temperature of 20° C. and a relative humidity below 50%, is immersed in the developer at a temperature of 33° C. for 20 seconds.

The viscosity of the viscous developer of the present invention should be 3 to 100 CP at 20° C., and an alkali-soluble hydrophilic polymer is used as a thickener. Examples of such polymers include sodium salts such as those of polyacrylamide, hydroxypropylcellulose, polyethylene oxide, carboxymethylcellulose and hydroxyethylcellulose. The thickener may be an alkali-soluble polymer compound comprising a saccharide such as polysaccharide gum.

The viscosity of the viscous developer of the present invention is preferably 5 to 50 CP, more preferably 5 to 20 CP, at 20° C., though it varies among supplier of the developer, transfer apparatuses, etc.

The amount of viscous developer retained in the light-sensitive material is normally 50 to 250 $ml/m^2$, preferably 50 to 180 $ml/m^2$.

The amount of thickener used is determined on the basis of the conditions described above, the type of the compound and other aspects. For example, in the case of carboxymethylcellulose, the amount may be in the range of from 0.5 to 2.5 g per liter developer. The thickener may be added at the commencement of preparation of the developer, or may be mixed with the developer just before use for development. The thickener may be used singly or in combination to obtain a viscous developer possessing the desired fluidity.

The binders usable in the light-sensitive material of the present invention are water-soluble polymers such as synthetic water-soluble polymers and natural water-soluble polymers. Both of these two types of polymers can serve well for the present invention. Water-soluble polymers are those having in molecular structure thereof, for example, a nonionic group, an anionic group and both a nonionic group and an anionic group. Examples of nonionic groups include an ether group, an ethylene oxide group and a hydroxy group. Examples of anionic groups include a sulfonic acid group or its salt, a carboxylic acid group or its salt and a phosphoric acid group or its salt.

Specific examples of synthetic water-soluble polymers which can serve well for the present invention are given below.

Examples of preferable natural water-soluble polymers include lignin, starch, pullulan, cellulose, alginic acid, dextran, dextrin, guar gum, gum arabic, glycogen, laminaran, lichenin and nigeran and derivatives thereof.

The natural water-soluble polymer may also be a sulfonated, carboxylated or phosphorylated product thereof, and also may be a polyoxyalkylated, alkylated or otherwise converted product thereof.

Among the natural water-soluble polymers, glucose polymers and derivatives thereof are preferred, with particular preference given to starch, glycogen, cellulose, lichenin, dextran and nigeran, with still more preference given to dextran and derivatives thereof.

| | | Number-average molecular weight |
|---|---|---|
| P-1 | $\leftarrow CH_2-CH(OH)\rightarrow_{100}$ | 8,000 |
| P-2 | $\leftarrow CH_2CH(CONH_2)\rightarrow_{45}\leftarrow CH_2-CH(C_6H_4SO_3K)\rightarrow_{5}$ | 15,000 |
| P-3 | $\leftarrow CH_2-CH(COOH)\rightarrow_{100}$ | 4,800 |
| P-4 | $\leftarrow CH_2-CH(N{<}C{=}O)\rightarrow_{100}$ | 3,100 |
| P-5 | $\leftarrow CH_2-CH(CH_2NH_2)\rightarrow_{100}$ | 11,000 |
| P-6 | $\leftarrow CH_2-CH(CONH_2)\rightarrow_{100}$ | 8,000 |
| P-7 | $\leftarrow CH_2-CH(CONH-C_3H_{7iso})\rightarrow_{100}$ | 6,000 |
| P-8 | $\leftarrow CH_2-CH(C_6H_4SO_3Na)\rightarrow_{100}$ | 7,800 |
| P-9 | $\leftarrow CH_2-CH(OH)\rightarrow_{93}\leftarrow CH_2-CH(OCOCH_3)\rightarrow_{3}$ | 9,000 |
| P-10 | $\leftarrow CH_2-CH(CONH_2)\rightarrow_{98}\leftarrow CH_2-CH(COOH)\rightarrow_{2}$ | 12,000 |
| P-11 | $\leftarrow CH_2-CH(COOCH_2CH_2OH)\rightarrow_{90}\leftarrow CH_2-CH(CONH_2)\rightarrow_{10}CH(CCH_2SO_3Na)(CH_3)$ | 8,000 |

Examples of dextran include dextran sulfate, carboxyalkyldextrans and hydroxyalkyldextrans. These natural water-soluble polymers preferably have a molecular weight of 1,000 to 100,000, more preferably 2,000 to 500,000.

Production methods for these dextrans and derivatives thereof are described in detail in Japanese Patent Examined Publication Nos. 11989/1960, 12820/1970, 18418/1970, 40149/1970 and 31192/1971, and U.S. Pat. No. 3,762,924.

Gelatin also serve well as a binder in the light-sensitive material of the present invention. Specifically, any gelatin used as a binder in photographic light-sensitive materials by those skilled in the art, such as limed gelatin and acid-treated gelatin, can be used.

These water-soluble binders are used in amounts required for the light-sensitive material to swell upon development and retain the developer at 50 to 250 ml/m$^2$. The amount of use varies among compounds, developer viscosities, etc., but an object of the present invention is accomplished by using it in the range of from 0.1 to 20 g/m$^2$, preferably 1.0 to 10 g/m$^2$.

After completion of the developing process of the present invention, with a stop solution added or washing carried out to stop development, if necessary, fixation is carried out, followed by washing and drying to yield an image.

Transfer speed is normally 0.1 to 8.0 m/min, preferably 0.5 to 3.0 m/min.

The silver halide photographic light-sensitive material applied to the developing method of the present invention may be any silver halide such as silver iodobromide, silver iodochloride and silver iodochlorobromide, with preference given to silver iodobromide from the viewpoint of high sensitivity.

The emulsion of the present invention can be formulated with various photographic additives in a process preceding or following physical ripening or chemical ripening.

An appropriate support is a plastic film. Such a support may be treated usually to improve coating layer adhesion by forming a subbing layer or performing corona discharge, ultraviolet irradiation, etc. The support thus treated may be coated with the emulsion of the present invention on either or both sides thereof.

The present invention is applicable to all silver halide photographic light-sensitive materials, but it is particularly suitable to high-sensitivity black-and-white light-sensitive materials.

When applying the present invention to medical X ray radiography, a fluorescent intensifying screen mainly comprising a phosphor which generates near ultraviolet or visible light in response to exposure to transmitting radiation. It is desirable to place this fluorescent intensifying screen in close contact with both sides of a light-sensitive material formed by coating the emulsion of the present invention on both sides thereof and subject it to exposure.

The transmitting radiation mentioned here means a high energy electromagnetic wave, including X ray and gamma ray.

Examples of fluorescent intensifying screens include an intensifying screen mainly comprising a phosphor of calcium tungstate or another intensifying screen mainly comprising a terbium-activated rare earth compound.

EXAMPLE 1

In the presence of monodispersible grains of silver iodobromide having an average grain size of 0.2 μm wherein the silver iodide content was 2.0 mol % as the nuclei, silver iodobromide containing 30 mol % silver iodide was grown at a pH of 9.1 and a pAg of 7.7. Then, potassium bromide and silver nitrate were added in an equimolar ratio at a pH of 8.0 and a pAg of 9.1 to yield a monodispersible emulsion of silver iodobromide having an average grain size of 1.02 μm, 0.58 μm or 0.45 μm wherein the average silver iodobromide content was 2.1 mol.

The emulsion was desalted to remove the excess salts by an ordinary coagulation method. Specifically, while keeping the emulsion at 40° C., a formalin condensation product of sodium naphthalenesulfonate and an aqueous solution of magnesium sulfate were added to coagulate the emulsion. After supernatant removal, pure water below 40° C. was added and then an aqueous solution of magnesium sulfate was again added to cause coagulation, followed by supernatant removal. These granular products were each subjected to chemical ripening by the addition of ammonium thiocyanate at $1.9\times10^{-3}$ mol per mol silver, an appropriate amount of chloroauric acid, hypo and a mixture of the spectral sensitizing dyes A and B described below in a ratio by weight of 200 to 1 in a total amount of 800 mg per mol silver halide. Potassium iodide was added at 200 mg per mol silver 15 minutes before completion of chemical ripening. Then, $3\times10^{-2}$ mol 4-hydroxy-6-methyl-1,3a,7-tetrazaindene was added for stabilization, and the three kinds of emulsion grains were mixed in a ratio of 15% to 60% to 25% in the descending order of grain size, followed by addition of the additives listed below and lime-treated gelatin to yield an emulsion coating solution (1).

The spectral sensitizing dyes used for sample preparation are as follows:

Spectral sensitizing dye A

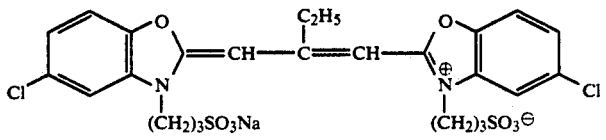

Spectral sensitizing dye B

-continued

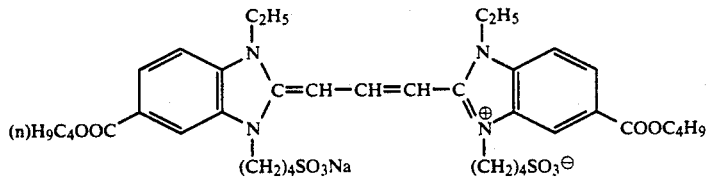

The additives used in the emulsion (light-sensitive silver halide coating solution) are as follows: The amount of addition is expressed in a ratio per mol silver halide.

| | |
|---|---|
| 1,1-dimethylol-1-bromo-1-nitromethane | 70 mg |
| 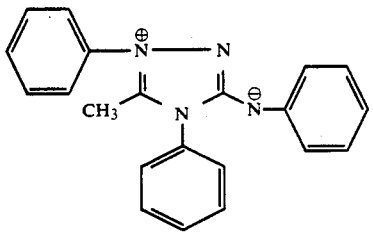 | 150 mg |
| t-butyl-catechol | 400 mg |
| Polyvinylpyrrolidone (molecular weight 10,000) | 1.0 mg |
| Styrene-maleic anhydride copolymer | 2.5 g |
| Trimethylolpropane | 10 g |
| Diethylene glycol | 5 g |
| Nitrophenyl-triphenylphosphonium chloride | 50 mg |
| Ammonium 1,3-hydroxybenzene-4-sulfonate | 4 g |
| Sodium 2-mercaptobenzimidazole-5-sulfonate | 1.5 mg |
| 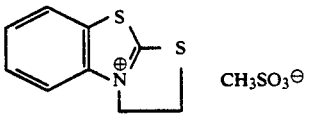 | 70 mg |
| 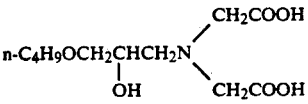 | 1 g |

The additives used in the protective layer solution are as follows: The amount of addition is expressed in ratio per liter coating solution.

| | |
|---|---|
| Lime-treated inert gelatin | 68 g |
| Acid-treated gelatin | 2 g |
| $NaO_3S-CH(CH_2COOC_{10}H_{21})-COOC_5H_{11}$ (coating aid) | 1 g |

-continued

| | |
|---|---|
| Polymethyl methacrylate as a matting agent having an area-average grain size of 3.5 μm | 1.1 g |
| Silicon dioxide grain as a matting agent having an area-average grain size of 1.2 μm | 0.5 g |
| Ludox AM (produced by DuPont) (colloidal silica) | 30 g |
| 2% aqueous solution of 2,4-dichloro-6-hydroxy-1,3,5-triazine sodium salt (hardener) | 10 ml |
| Bisvinylsulfonylmethyl ether | 0.5 g |
| 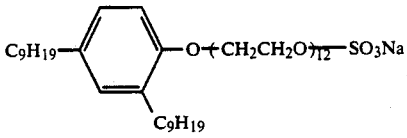 | 1.0 g |
| 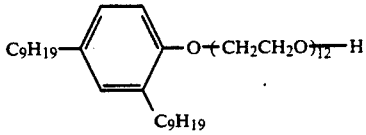 | 0.4 g |
| $CH_2COO(CH_2)_3CH_3$ / $CHCOO(CH_2)_2CH(CH_3)_2$ / $SO_3Na$ | 0.3 g |
| 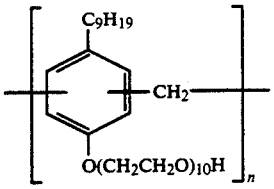 (n represents an integer of 2 to 5) | 2.5 g |
| $NaO_3S-CH(CH_2COOCH_2(C_2F_4)_3H)-COOCH_2(C_2F_4)_3H$ | 0.5 g |
| $F_{19}C_9-O-(CH_2CH_2O)_{10}-CH_2CH_2-OH$ | 33 mg |
| $C_4F_9SO_3K$ | 22 mg |

In addition to the additives shown above, the following compounds (1) and (2) were added to the coating solution to reach the following concentrations per mol silver halide.

(1) 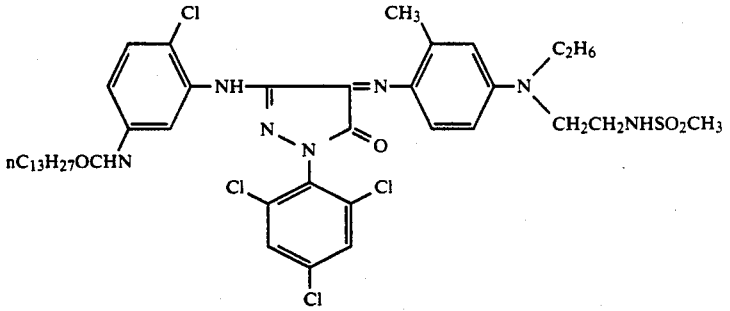

200 mg (2) Tricresyl phosphate 0.6 g

Accordingly, compound (1) was dissolved in an oil comprising compound (2) in accordance with the method described in Example 1 (3) of Japanese Patent Publication Open to Public Inspection No. 285445/1986 to yield a dispersion in hydrophilic colloidal solution, which was added to the coating solution.

The resulting emulsion (1) was coated simultaneously on both sides of a polyethylene terephthalate film base of 175 μm in thickness whereon an aqueous dispersion obtained by diluting a copolymer comprising three kinds of monomers of 50 wt % glycidyl methacrylate, 10 wt % methyl acrylate and 40 wt % butyl methacrylate to a concentration of 10 wt % was coated as an subbing solution, using a slide hopper type coater at a speed of 60 m per minute, to reach a final silver content of 2.0 g/m$^2$ in the light-sensitive layer and a final gelatin ratio of 1.0 g/m$^2$ in the protective layer, followed by drying for 2 minutes and 15 seconds to yield a sample (1).

The resulting sample (1) was placed between two sheets of fluorescent intensifying screen KO-250 (produced by Konica Corporation) and irradiated with X ray at a tube voltage of 90 kvp for exposure so that the density after development would be in the range of from 1.0 to 1.2.

Development was carried out using the light-sensitive material processor illustrated in the figures with the silver halide photographic light-sensitive material transfer speed varied so that the solution supply time intervals shown in Table 1 were obtained.

Next, fixation and washing were carried out using a conventional roller transfer immersion type automatic developing machine. The developer used had the following composition.

| | |
|---|---|
| Potassium sulfite | 70 g |
| Trisodium hydroxyethylethylenediaminetriacetate | 8 g |
| 1,4-dihydroxybenzene | 28 g |
| Boric acid | 10 g |
| 5-methylbenztriazole | 0.04 g |
| 1-phenyl-5-mercaptotetrazole | 0.01 g |
| Sodium metabisulfite | 5 g |
| Acetic acid (90%) | 13 g |
| Triethylene glycol | 15 g |
| 1-phenyl-3-pyrazolidone | 1.2 g |
| 5-nitroindazole | 0.2 g |
| Glutaraldehyde | 4.0 g |
| 1-phenyl-4-hydroxymethyl-3-pyrazolidone | 1.0 g |
| Disodium ethylenediaminetetraacetate | 2.0 g |
| Potassium bromide | 4.0 g |
| 5-nitrobenzimidazole | 1.0 g |

This mixture was prepared as 1 l of an aqueous solution and adjusted to a pH of 10.50 with potassium hydroxide.

-continued

| Fixer components | g/l | mol/l |
|---|---|---|
| Sodium thiosulfate pentahydrate | 45 | |
| Disodium ethylenediaminetetraacetate | 0.5 | |
| Ammonium thiosulfate | 150 | |
| Sodium sulfite | 13.9 | 0.11 |
| Potassium acetate | 16 | |
| Aluminum sulfate.10–18$H_2O$ | 27.0 | |
| Sulfuric acid (% wt %) | 5 | |
| Citric acid | 1 | |
| Boric acid | 7 | |
| Sulfuric acid | 0.025 | |

Water was added in an amount required to reach a total quantity of 1 l.

Glacial acetic acid was added in an amount required to reach a pH of 4.0

Each sample was subjected to exposure at 3.2 CMS in the absence of a filter for 0.1 second using as light source the standard light B described in "New Edition, Lighting Data Book", edited by the Illuminating Engineering Institute of Japan, 1st edition, 2nd print, p. 39.

These exposed samples were processed as above to yield developed samples.

The developed samples thus obtained were subjected to densitometry using a PDA-65 densitometer, produced by Konica Corporation, and the reciprocal of the amount of light necessary to reach the density (one-fourth of the maximum density+fogging) of each sample was calculated for sensitivity. Table 1 shows the relative sensitivity of each sample in comparison to the sensitivity of sample No. 5 taken as 100, contrast (gamma value) for densities between 1.0 and 2.0, and Dmax.

TABLE 1

| No. | Solution supply frequency | Solution supply time interval | Relative sensitivity | Gamma value | Dmax | Remarks |
|---|---|---|---|---|---|---|
| 1 | 1 | — | 70 | 1.60 | 2.20 | Comparative |
| 2 | 2 | 5 seconds | 90 | 2.05 | 2.90 | Inventive |
| 3 | 2 | 10 | 90 | 2.10 | 2.95 | Inventive |
| 4 | 2 | 15 | 80 | 1.80 | 2.50 | Comparative |
| 5 | 3 | 5 | 100 | 2.20 | 3.00 | Inventive |
| 6 | 4 | 5 | 102 | 2.25 | 3.05 | Inventive |
| 7 | 5 | 5 | 105 | 2.30 | 3.10 | Inventive |
| 8 | 6 | 2 | 100 | 2.25 | 3.10 | Inventive |
| 9 | 6 | 5 | 105 | 2.35 | 3.10 | Inventive |
| 10 | 6 | 10 | 105 | 2.35 | 3.10 | Inventive |
| 11 | 6 | 15 | 95 | 1.90 | 2.80 | Comparative |
| 12 | 6 | 20 | 90 | 1.70 | 2.60 | Comparative |

TABLE 1-continued

| No. | Solution supply frequency | Solution supply time interval | Relative sensitivity | Gamma value | Dmax | Remarks |
|---|---|---|---|---|---|---|
| 13 | 8 | 2 | 105 | 2.35 | 3.10 | Inventive |

As is evident from Table 1, the samples processed in accordance with the present invention showed almost no gamma value reduction or Dmax reduction, and gave good photographic characteristics.

volume of 200 cc per mol AgX. Then, 1.8 l/mol AgX of pure water at 40° C. was added, followed by stirring for 5 minutes. Then, 20 g/mol AgX of $MgSO_4$ was added, and this mixture was stirred and then kept standing, followed by supernatant discarding for desalting, in the same manner as above. Then, this solution was stirred, and then gelatin was added to redisperse the AgX.

While maintaining the resulting emulsion at 55° C., the following sensitizing dyes (1) and (2) were added, followed by the addition of ammonium thiocyanate, chloroauric acid and hypo for gold-sulfur sensitization. After completion of sensitization, 4-hydroxy-6-methyl-1,3,3a,7-tetrazaindene was added.

Sensitizing dye (1)

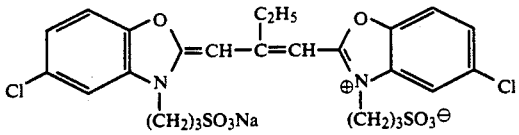

0.6 g/mol AgX

Sensitizing dye (2)

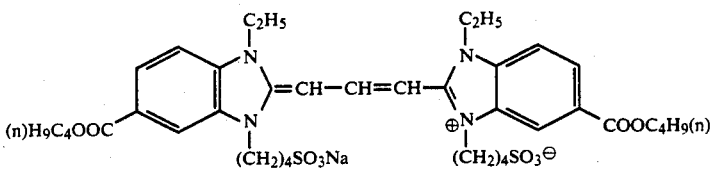

20 mg/mol AgX

EXAMPLE 2

Preparation of photographic samples

While maintaining a temperature of 60° C., a pAg of 8 and a pH of 2.0, a monodispersible cubic emulsion (A) of silver iodobromide having an average grain size of 0.3 μm wherein the silver iodide content was 2 mol % was obtained by the double jet method. This emulsion was examined on electron micrographs and found to have a twin formation ratio of not more than 1% by number. This emulsion (A), as a seed crystal, was grown as follows:

This seed crystal (A) was dissolved in 8.5 l of a solution containing a protective gelatin being kept at 40° C. and, if needed, ammonia, and its pH was adjusted with acetic acid.

Using this solution as the mother solution, an aqueous solution of ammoniac silver ions was added by the double jet method.

While maintaining a pAg of 7.3 and a pH of 9.7, a layer having a silver iodide content of 30 mol % was formed. Then, grains were grown until the grain size reached 95% of the full size while changing the pH from 9 to 8.2 and maintaining a pAg of 9.0. Then, a solution of potassium bromide was added over a period of 8 minutes, and the pAg was reduced to 11.0. Mixing was completed 3 minutes after completion of the addition of potassium bromide. The resulting emulsion had an average grain size of 0.7 m and an overall silver iodide content of about 2.0 mol %.

Next, a desalting process was carried out to remove the excess soluble salts from the reaction mixture. Specifically, while maintaining the reaction mixture at 40° C., 5 g/mol AgX of the compound (I) described below and 8 g/mol AgX of $MgSO_4$ were added, and this mixture was stirred for 5 minutes and then kept standing. Then, the supernatant was discarded to reach a solution Emulsion coating solutions were prepared by adding to these emulsions 400 mg of t-butyl-catechol, 1.0 g of polyvinylpyrrolidone (molecular weight 10,000), 2.5 g of a styrene-maleic anhydride copolymer, 10 g of trimethylolpropane, 5 g of diethylene glycol, 50 mg of nitrophenyl-triphenylphosphonium chloride, 4 g of ammonium 1,3-dihydroxybenzene-4-sulfonate, 15 mg of sodium 2-mercaptobenzimidazole-5-sulfonate

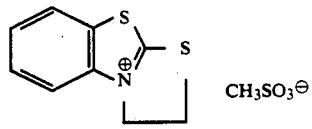

70 mg

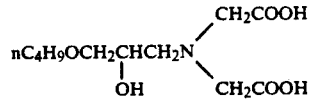

1 g

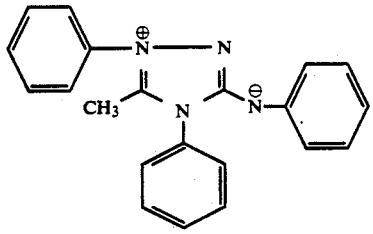

150 mg and 10 mg of 1,1-dimethylol-1-bromo-1-nitromethane, all per mol AgX.

Also added were the following compounds as protective layer additives (the amount of addition is expressed per gram gelatin).

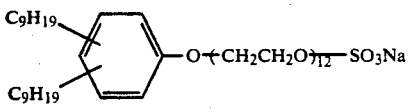

10 mg

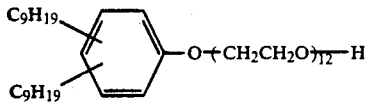

2 mg

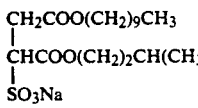

7 mg

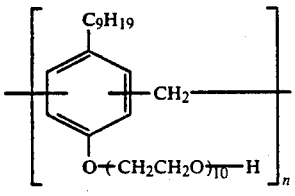

15 mg (n represents an integer of 2 to 5.)

Then, 7 mg of a matting agent comprising polymethyl methacrylate having an average grain size of 5 μm, 70 mg of colloidal silica having an average grain size of 0.013 μm, 8 mg of $(CHO)_2$ and 6 mg of HCHO were added to yield a protective layer coating solution.

The each resulting coating solution was coated on a polyethylene terephthalate blue base of 180 μm in thickness subbed with an aqueous dispersion obtained by diluting a copolymer comprising three kinds of monomers of 50 wt % glycidyl methacrylate, 10 wt % methyl acrylate and 40 wt % butyl methacrylate to reach a concentration of 10 wt %.

An emulsion layer and a protective layer were simultaneously coated in this order from support on both sides of the base, followed by drying to yield a sample. The resulting sample was kept standing in an atmosphere at 23° C. and 55% RH for 3 days to obtain stable hardening, after which the following developing experiment was conducted.

The amount of silver coated was 5 g/m$^2$ in total for both sides. The protective coating solution was a 3% gelatin solution. The amount of gelatin coated and the amount of water-soluble polymer in the emulsion layer and protective layer are shown in Table 2.

Compounds used in Examples

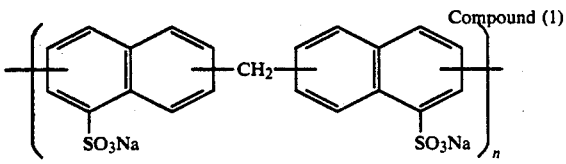

Compound (1)

(n = 4~6)

Preparation of processing solutions

A developer and a fixer were prepared, which had the following compositions.

| Developer | |
|---|---|
| Potassium sulfite | 55 g |
| Hydroquinone | 25 g |
| 1-phenyl-3-pyrazolidone | 1.2 g |
| Boric acid | 10.0 g |
| Sodium hydroxide | 21.0 g |
| Triethylene glycol | 17.5 g |
| 5-nitrobenzimidazole | 0.10 g |
| Glutaraldehyde bisulfite | 15.0 g |
| Glacial acetic acid | 16.0 g |
| Potassium bromide | 4.0 g |
| Triethylenetetramine hexaacetate | 2.5 g |

Water was added in an amount required to reach a total quantity of 900 ml.

Then, carboxymethylcellulose was added in an amount shown in Table 2 to reach a total quantity of 1 l (otherwise water was added to reach a total quantity of 1 l.)

| Fixer | |
|---|---|
| Ammonium thiosulfate | 130.0 g |
| Anhydrous sodium sulfite | 7.3 g |
| Boric acid | 7.0 g |
| Acetic acid (90 wt %) | 5.5 g |
| Sodium acetate trihydrate | 25.8 g |
| Aluminum sulfate.18$H_2O$ | 14.6 g |
| Sulfuric acid (50 wt %) | 6.77 g |

Water was added in an amount required to reach a total quantity of 900 ml.

Developing experiment

While supplying each developer listed in Table 2 at 35° C. to the unit illustrated in FIG. 1 at a rate of 20 ml/min, a coated sample was passed between the rollers at a speed of 16 cm/sec for development. Then, after immersion in the fixer, the sample was washed and dried and assessed as to uneven development. At the same time, samples for sensitometry and those for determination of graininess were prepared.

The degree of development unevenness was evaluated on the basis of the following criteria:

5: Absolutely no problem
4: Practically no problem
3: Slight problem level
2: Considerable unevenness with little practicality
1: Very much unevenness with no practicality As for sensitivity, it was obtained as a common logarithm of the reciprocal of the amount of exposure necessary to provide a density of "fogging+1.0", and is expressed in relative value in comparison with the sensitivity obtained when development was carried out using a developer of sample No. 1, taken as 100.

Graininess (RMS) is expressed by multiplying the standard deviation for the variance of density occurring in microdensitometer scanning by 1000.

The microdensitometer had an aperture size of 100 μm×200 μm.

The obtained results are shown in Table 2 below.

TABLE 2

| Sample number | GEL mg/m² | Water-soluble polymer | g/m² | CMC content g/l dev | Amount of developer retained cc/m² | Relative sensitivity | Graininess | Development unevenness | Remarks |
|---|---|---|---|---|---|---|---|---|---|
| 1 | 0.5 | — | — | — | 30 | 100 | 0.23 | 1.0 | Comparative |
| 2 | 0.8 | — | — | — | 35 | 112 | 0.26 | 1.0 | Comparative |
| 3 | 1.0 | — | — | — | 50 | 130 | 0.21 | 3.0 | Inventive |
| 4 | 1.5 | — | — | — | 55 | 134 | 0.21 | 4.0 | Inventive |
| 5 | 3.0 | — | — | — | 60 | 135 | 0.23 | 4.0 | Inventive |
| 6 | 6.0 | — | — | — | 78 | 134 | 0.22 | 4.0 | Inventive |
| 7 | 0.5 | A* | 0.1 | — | 35 | 105 | 0.12 | 1.0 | Comparative |
| 8 | 1.5 | A | 0.7 | — | 76 | 138 | 0.21 | 5.0 | Inventive |
| 9 | 3.0 | A | 1.0 | — | 63 | 139 | 0.23 | 5.0 | Inventive |
| 10 | 4.0 | A | 2.0 | — | 95 | 132 | 0.21 | 4.0 | Inventive |
| 11 | 0.5 | B* | 0.1 | — | 38 | 105 | 0.13 | 2.0 | Comparative |
| 12 | 1.5 | B | 0.7 | — | 76 | 137 | 0.24 | 5.0 | Inventive |
| 13 | 3.0 | B | 1.0 | — | 64 | 138 | 0.24 | 5.0 | Inventive |
| 14 | 4.0 | B | 2.0 | — | 95 | 130 | 0.21 | 4.0 | Inventive |
| 15 | 0.8 | — | — | 1.0 | 115 | 136 | 0.21 | 5.0 | Inventive |
| 16 | 1.5 | A | 0.1 | 1.0 | 80 | 139 | 0.20 | 5.0 | Inventive |
| 17 | 0.8 | B | — | 2.0 | 190 | 135 | 0.21 | 5.0 | Inventive |
| 18 | 3.0 | B | — | 1.0 | 143 | 133 | 0.21 | 5.0 | Inventive |
| 19 | 3.0 | B | 0.1 | 3.0 | 270 | 130 | 0.24 | 1.0 | Comparative |

A*: Polyacrylamide (average $\overline{MW}$ = 10,000)
B*: Dextran (average $\overline{MW}$ = 30,000)

As is evident from the results shown in Table 2, the samples obtained in accordance with the present invention yielded an image free of development unevenness with high sensitivity and excellent graininess. It was found that when the amount of developer retained is out of the range of the present invention, significant development unevenness occurs and sensitivity and graininess are considerably deteriorated.

What is claimed is:

1. A method of developing a silver halide photographic material, comprising a step of supplying a developer at least twice and intermittently, with an interval time of each supplying being not more than 10 seconds, to a surface of an exposed silver halide photographic material, wherein the photographic material is transferred between at least a pair of rollers and wherein the amount of developer retained in the light-sensitive material ranges from 50 to 250 ml/m².

2. A method as claimed in claim 1, wherein the developer is supplied to more than one surface of the photographic material.

3. A method as claimed in claim 1, wherein an amount of the supplied developer is 50 to 180 ml per 1 m² of the photographic material.

4. A method as claimed in claim 1, wherein the at least one of the rollers is kept warm.

5. A method as claimed in claim 1, wherein the viscosity of the developer is 3 to 100CP at 20° C.

6. A method as claimed in claim 1, wherein the developer comprises carboxymethylcellulose in an amount of 0.5 to 2.5 g per liter developer.

7. A method as claimed in claim 1, wherein the developer is supplied to the photographic material by the rollers.

8. A method as claimed in claim 1, wherein the developer is supplied between the rollers and the photographic material.

* * * * *